US009747918B2

(12) United States Patent
Lupini et al.

(10) Patent No.: US 9,747,918 B2
(45) **Date of Patent: *Aug. 29, 2017**

(54) DYNAMICALLY ADAPTED PITCH CORRECTION BASED ON AUDIO INPUT

(71) Applicant: Harman International Industries, Inc., Stamford, CT (US)

(72) Inventors: Peter R. Lupini, Victoria (CA); Glen A. Rutledge, Brentwood Bay (CA); Norm Campbell, Delta (CA)

(73) Assignee: Harman International Industries, Incorporated, Stamford, CT (US)

( * ) Notice: Subject to any disclaimer, the term of this patent is extended or adjusted under 35 U.S.C. 154(b) by 83 days.

This patent is subject to a terminal disclaimer.

(21) Appl. No.: 14/819,854

(22) Filed: Aug. 6, 2015

(65) Prior Publication Data

US 2015/0348567 A1 Dec. 3, 2015

Related U.S. Application Data

(63) Continuation of application No. 13/723,521, filed on Dec. 21, 2012, now Pat. No. 9,123,353.

(51) Int. Cl.

| | |
|---|---|
| ***G10L 21/00*** | (2013.01) |
| ***G10L 21/013*** | (2013.01) |
| ***G10L 25/90*** | (2013.01) |
| ***G10H 1/36*** | (2006.01) |
| ***G10H 1/38*** | (2006.01) |
| *G10L 25/03* | (2013.01) |

(52) U.S. Cl.

CPC ..... *G10L 21/013* (2013.01); *G10H 1/366* (2013.01); *G10H 1/383* (2013.01); *G10L 25/90* (2013.01); *G10H 2210/021* (2013.01); *G10H 2210/331* (2013.01); *G10L 25/03* (2013.01); *G10L 2025/906* (2013.01)

(58) Field of Classification Search

CPC ..... G10H 1/366; G10L 25/90; G10L 21/003
USPC ..... 704/203; 84/612
See application file for complete search history.

(56) References Cited

U.S. PATENT DOCUMENTS 5,231,671 A * 7/1993 Gibson ..... G10G 7/02 704/205
5,641,927 A 6/1997 Pawate
5,986,198 A * 11/1999 Gibson ..... G10H 1/20 84/603
5,986,199 A 11/1999 Peevers
(Continued)

OTHER PUBLICATIONS

IEEE Standard Dictionary of Electrical and Electronics Terms, Second Edition, May 12, 1978.
(Continued)

*Primary Examiner* — Daniel Abebe
(74) *Attorney, Agent, or Firm* — Brooks Kushman, P.C.

(57) ABSTRACT

Systems and methods for adjusting pitch of an audio signal include detecting input notes in the audio signal, mapping the input notes to corresponding output notes, each output note having an associated upper note boundary and lower note boundary, and modifying at least one of the upper note boundary and the lower note boundary of at least one output note in response to previously received input notes. Pitch of the input notes may be shifted to match an associated pitch of corresponding output notes. Delay of the pitch shifting process may be dynamically adjusted based on detected stability of the input notes.

16 Claims, 5 Drawing Sheets

(56) References Cited

U.S. PATENT DOCUMENTS

| | | | | |
|---|---|---|---|---|
| 6,087,578 | A | 7/2000 | Kay | |
| 6,121,532 | A | 9/2000 | Kay | |
| 7,663,049 | B2 * | 2/2010 | Puryear ..... | G10H 1/0066 84/609 |
| 8,168,877 | B1 | 5/2012 | Rutledge | |
| 2004/0221710 | A1 | 11/2004 | Kitayama | |
| 2006/0165240 | A1 | 7/2006 | Bloom | |
| 2010/0043626 | A1 | 2/2010 | Lin | |
| 2013/0339035 | A1 | 12/2013 | Chordia et al. | |
| 2014/0074459 | A1 | 3/2014 | Chordia et al. | |

OTHER PUBLICATIONS

Linear Predictive Coding, Wikipedia Foundation, Inc., en.wikipedia.org/wiki/Linear_predictive_coding, Aug. 30, 2012.
Extended Search Report dated Apr. 15, 2014 for corresponding European application 13198056.7 filed Dec. 21, 2012.

* cited by examiner

DYNAMICALLY ADAPTED PITCH CORRECTION BASED ON AUDIO INPUT

CROSS-REFERENCE TO RELATED APPLICATIONS

This application is a continuation of U.S. application Ser. No. 13/723,521 filed Dec. 21, 2012, now U.S. Pat. No. 9,123,353, issued on Sep. 1, 2015, the disclosure of which is hereby incorporated in its entirety by reference herein.

TECHNICAL FIELD

This disclosure relates to musical vocal effect processors that may include live or near real-time vocal pitch correction.

BACKGROUND AND SUMMARY

A vocal effect processor is a device that is capable of modifying an input vocal signal to change the sound of the voice. Pitch correction processors shift the pitch of an input vocal signal, usually to improve the intonation of the vocal signal such that it better matches the notes of a musical key or scale. Pitch correction processors can be classified as "non real-time" or "real-time." Non real-time pitch correction processors are generally run as file-based software plug-ins and can use multi-pass processing to improve the quality of the processing. Real-time pitch correction processors operate with fast processing using minimal look-ahead such that the processed output voices are produced with very short delays of less than about 500 ms and preferably less than about 25 ms, making it practical for use during a live performance. Typically, a pitch correction processor will have at least a microphone connected to the input at which a monophonic signal is expected, and will produce a monophonic output signal. Pitch correction processors may also incorporate other vocal effects such as reverb and compression, for example.

Pitch correction is a method of correcting the intonation of an input audio signal to better match a desired target pitch that is musically correct. Pitch correction processors work by detecting the input pitch being sung by a performer, determining the desired output note, and then shifting the input signal such that the output signal pitch is closer to the desired note. One of the most important aspects of all pitch correction systems is the mapping between the input pitch and the desired target pitch. In some systems, the musically correct or target pitch is known at every instant in time. For example, when pitch correcting to a known guide track or channel, such as the melody notes in a MIDI file, each target note is known in advance. Therefore, the mapping simply reduces to choosing the target pitch regardless of the input pitch. However, in most situations, the intended target pitch is not known in advance and therefore must be inferred based on the input notes and possibly other information, such as a predetermined key and scale, for example.

This disclosure provides representative embodiments for music corresponding with the western 12-tone scale, although it will be clear to those of ordinary skill in the art that this description can be adapted to any musical system or scale that defines discrete notes. In some systems, the target scale is assumed to be a chromatic scale that encompasses all 12 tones in a scale according to a predetermined scale reference frequency such as A=440 Hz. In other systems, the target or predefined scale may include a subset of the available tones. For example, a C♯-major scale that includes a predefined subset of seven notes may be used. In either case, the vocal effect processor needs to include a mapping between all the possible input pitches, and the discrete set of desired output notes.

There are several problems with the existing state of the art in pitch correction. For example, when a chromatic scale is used and the singer misses the desired target note by more than half a semitone, the wrong target note will generally be selected. Also, when a singer is using vibrato or some other pitch effect that has a large pitch deviation, the correction may result in the selected output note jumping or oscillating between two notes. Using a scale with fewer output notes than a chromatic scale, such as the seven notes in a major scale, can help to alleviate both of these problems. However, this often results in another major problem: many songs have short sections in which the localized key or tonal center is different from the global key of the song. For example, an A-major chord, which includes the notes of A, C♯, and E may be played during a song that is globally in the key of G-major, which does not include C♯. In this case, the melody may include a note (C♯) that is not part of the global key (G-major), and therefore will not be selected by the pitch correction input to output mapping.

Another common complaint about the existing state of the art in pitch correction is the fact that, mostly as a consequence of the pitch detection and pitch shifting operations, there is always a time delay between the input audio and output audio of the pitch correction processor. In existing state of the art real-time pitch correction systems, this delay is approximately 20 ms. Singing with delays greater than about 10 ms can be difficult for many people, as the delay is similar to an echo that is very distracting to the performer.

Systems and methods according to embodiments of the present disclosure provide pitch correction while overcoming various shortcomings of previous strategies. In various embodiments, systems and methods for pitch correction dynamically adapt a mapping between detected input notes and corresponding corrected output notes. Note boundaries may be dynamically adjusted based on notes detected in an input vocal signal and/or an input accompaniment signal. The pitch of the input vocal note may then be adjusted to match a mapped output note. In various embodiments, delay of pitch shifting is dynamically adjusted in response to detecting a stable voiced note to reduce delay for note onsets and increase delay for stable notes, including voiced notes with vibrato.

In one embodiment, a system or method for processing a vocal signal and a non-vocal signal include detecting vocal input notes in the vocal signal, generating a vocal input note histogram based on number of occurrences of each detected vocal input note, detecting non-vocal input notes in the non-vocal signal, generating a non-vocal note histogram based on number of occurrences of each detected non-vocal input note, combining the vocal note histogram and non-vocal note histogram to generate a combined note histogram, mapping the vocal input notes to corresponding vocal output notes based on associated upper and lower note boundaries, shifting pitch of the vocal input notes to a pitch associated with the corresponding vocal output notes, adjusting the upper and/or lower note boundaries in response to the combined note histogram, determining if a pitch of a vocal input note is stable, and adjusting delay of pitch shifting based on whether the pitch of the vocal input note is stable.

In one embodiment, a system for adjusting pitch of an audio signal includes a first input configured to receive a vocal signal, a second input configured to receive a non-vocal signal, an output configured to provide a pitch-adjusted vocal signal, and a processor in communication with the first and second inputs and the output. The processor executes instructions stored in a computer readable storage device to detect input vocal notes in the vocal signal and input non-vocal notes in the non-vocal signal, map the input vocal notes to output vocal notes, each output vocal note having an associated upper note boundary and lower note boundary, modify at least one of the upper note boundary and the lower note boundary of at least one output note in response to previously received input vocal notes and input non-vocal notes, shift the pitch of the vocal signal to substantially match an output note pitch of a corresponding output vocal note, and generate a signal on the output corresponding to the shifted pitch vocal signal. The processor may be further configured to dynamically modify a delay for shifting the pitch in response to stability of an input vocal note. Various embodiments may include adjusting one or more note boundaries based on a likelihood of an associated note occurring. The likelihood of an associated note occurring may be based on previously identified notes, which may be reflected in corresponding note histograms, or a table of relative likelihood of occurrences, for example.

Embodiments according to the present disclosure may provide various advantages. For example, systems and methods according to the present disclosure dynamically adapt input to output mapping over the course of a song to accommodate local key changes or shifts in tonal center from a global key without requiring user input or a guide track. This results in musically correct output notes while accommodating an occasional output note that is not within the global key or scale, i.e. not diatonic.

DETAILED DESCRIPTION

Figure 1:
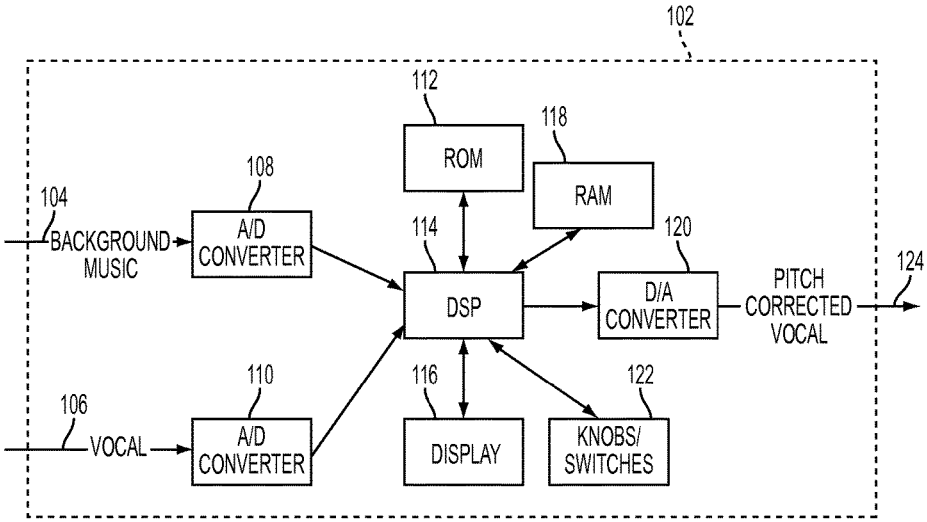
FIG. 1 is a block diagram illustrating various functions of a representative embodiment of a pitch correction system or method using a digital signal processor.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Various representative embodiments are illustrated and described with respect to one or more functional block diagrams. The operation or processing strategy depicted may generally be implemented by software or code stored in one or more computer readable storage devices and executed during operation by a general purpose and/or special purpose or custom processor, such as a digital signal processor, for example. Code may be processed using any of a number of known strategies such as event-driven, interrupt-driven, multi-tasking, multi-threading, and the like. As such, various steps or functions illustrated may be performed in the sequence illustrated, in parallel, or in some cases omitted. Likewise, various functions may be combined and performed by a single code function or dedicated chip, for example. Although not explicitly illustrated, one of ordinary skill in the art will recognize that one or more of the illustrated functions may be repeatedly performed depending upon the particular processing strategy being used. Similarly, the order of processing is not necessarily required to achieve the features and advantages described, but is provided for ease of illustration and description.

Depending on the particular application and implementation, a system or method performing the functions illustrated and described may implement the functions primarily in software, primarily in hardware, or a combination of software and hardware. When implemented in software, the strategy is preferably provided by code stored in one or more computer-readable storage devices having stored data representing the code or instructions executed by a computer or processor to perform the illustrated function(s). The computer-readable storage device(s) may include one or more of a number of known physical devices that utilize electric, magnetic, optical, and/or hybrid storage to keep executable instructions and associated data variables and parameters. The computer-readable storage device(s) may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions. In addition to solid state devices, the computer-readable storage device(s) may also include DVDs, CDs, hard disks, magnetic/optical tape, and the like. Those of ordinary skill in the art will recognize that various functions or data may be accessed using a wired or wireless local or wide area network. One or more computers or processors may be used to perform various functions and may be connected by a wired or wireless network.

As used herein, a signal or audio signal generally refers to a time-varying electrical signal voltage or current corresponding to a sound to be presented to one or more listeners. Such signals are generally produced with one or more audio transducers such as microphones, guitar pickups, speakers, or other devices. These signals can be processed by, for example, amplification, filtering, sampling, time-shifting, frequency-shifting, or other techniques prior to delivery to audio output devices such as speakers or headphones. A vocal signal typically refers to a signal whose source is a human singing or speaking voice. An analog signal or analog audio signal may also be sampled and converted to a digital representation. Various types of signal processing may be performed on the analog signal or equivalently on a digital representation of an analog signal. Those of ordinary skill in the art will recognize various advantages and/or disadvantages associated with an analog and/or digital implementation of a particular function or series of processing steps.

As used herein, a note generally refers to a musical sound associated with a predetermined fundamental frequency or pitch, or multiples thereof associated with different octaves. A note may also be referred to as a tone, particularly when generated by a musical instrument or an electronic device. References to detecting a note or generating a note may also include detecting or inferring one or more notes from a chord, which generally refers to notes sounded together as a basis of harmony. Similarly, a note may refer to a peak in spectral frequency of a multi-frequency or broad spectrum signal.

FIG. 1 is a block diagram illustrating operation of a representative pitch correction system 102 that receives the accompaniment music input signal 104 and a vocal input signal 106. The system generates a pitch corrected output vocal signal 124. The input signals are typically analog audio signals that are directed to analog to digital conversion blocks 108 and 110. In some embodiments, the input signals may already be in digital format and this function may be omitted or bypassed. The digital signals are then sent to a digital signal processor (DSP) 114 that stores the signals in a computer readable storage device implemented by random access memory (RAM) 118 in this representative embodiment. Read-only memory (ROM) 112 containing data and programming instructions is also connected to DSP 114. DSP 114 generates an output signal as described in greater detail herein. The output signals may be converted to analog signals using a digital-to-analog converter 120 and sent to an output port or jack 124. DSP 114 may also be coupled with or connected to one or more user interface components such as touch screens, displays, knobs, sliders, switches, etc. as generally represented by display 116 and knobs/switches 122 to allow the user to interact with the pitch correction system. As described in greater detail herein, user input may be used to adjust various operating parameters of system 102. Other user input devices such as mice, trackballs, or other pointing devices may also be provided. Likewise, input and/or output may be provided from/to a wired or wireless local or wide area network.

Figure 2:
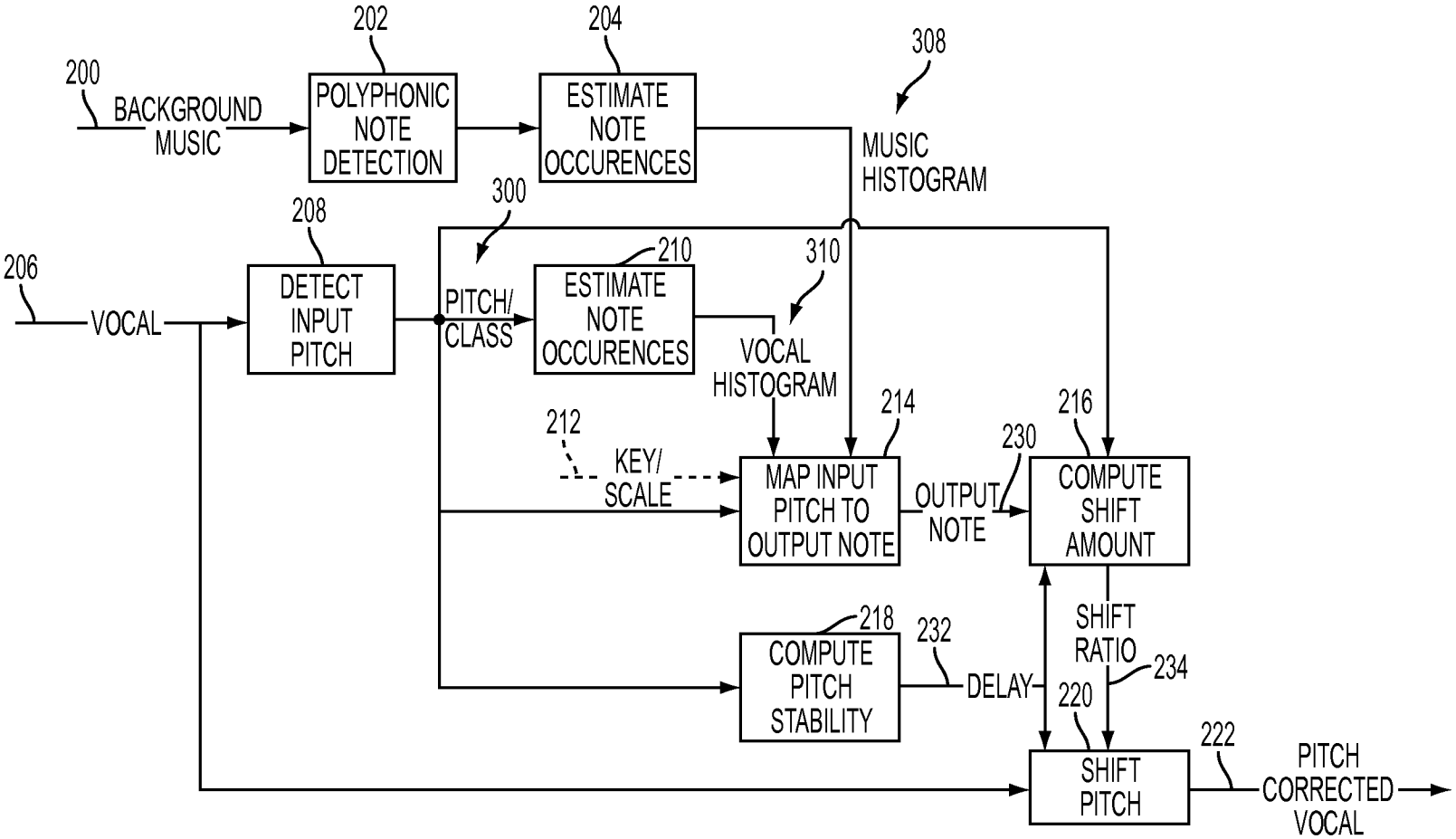
FIG. 2 is a block diagram illustrating operation of a representative embodiment of a pitch correction system or method with dynamic input to output note mapping and pitch-stability based low-latency shifting.

FIG. 2 is a block diagram illustrating operation of a pitch correction system or method with dynamic input to output note mapping and pitch-stability based low-latency shifting according to various embodiments of the present disclosure. In the representative embodiment illustrated, accompaniment or background music 200 is sent to a polyphonic note detection block 202. The background music could be, for example, a live guitar accompaniment or the signal coming from a microphone positioned to record the entire musical mix, etc. The polyphonic note detection block 202 is designed to determine the main notes that are currently being heard in the background music. As generally described above, one or more notes may be detected or inferred from an associated chord by the polyphonic note detection block.

There are many ways of determining notes from a polyphonic input signal, usually involving peak picking in the frequency domain, or the use of band pass filters with center frequencies set to expected note locations. One example of a method for polyphonic note detection is disclosed in U.S. Pat. No. 8,168,877, the disclosure of which is incorporated by reference in its entirety. In various embodiments of the disclosed pitch correction system, the note prevalence is time averaged and not used to instantaneously affect audio output. As such, the note detection processing for these embodiments does not need to be as robust as in other embodiments where the note prevalence may not be time averaged. For example, combining the outputs from a set of band-pass filters placed over expected note locations and appropriately accounting for harmonics can provide a reasonable estimate of note prevalence. In other embodiments, it is desired to affect the input to output pitch mapping as quickly as possible such that the polyphonic note detection is more robust and has lower latency as described in greater detail in U.S. Pat. No. 8,168,877. In general, various embodiments according to the present disclosure adjust one or more note boundaries based on the relative likelihood of a particular note occurring, which may be based on previously detected notes, a detected or predetermined key or tonal center, etc.

Once the spectral content of the input signal has been processed to detect one or more chords and/or notes using the polyphonic note detection block 202, the note information is sent to the Estimate Note Occurrences block 204 where time varying note prevalence histograms are calculated. One method of computing note histograms is to wrap the input notes onto a 12-note normalized scale where, for example, 0=C, 1=C$^{\sharp}$, 2=D, etc. At each frame, the histogram bin corresponding to the normalized note is updated according to the expression $h_k^{(i+1)}=\alpha h_k^i+(1-\alpha)P_k^i$ where $h_k^i$ is the histogram value at frame i for note k, $P_k^i$ is the note probability of note k detected by the polyphonic note detection block at frame i, and $\alpha$ is a time constant that determines the relative weighting of past data to data from the current frame. In this way, the energy levels in each note bin will be an estimate of the prevalence of the note corresponding to that bin over the time scale determined by $\alpha$. For example, when $\alpha$ approaches 1, the weighting from the past is increased relative to the weighting from the present frame. In some systems, the note probability is not explicitly estimated by the note detection system. In this case, the note probability can be set to one when the note is detected and zero otherwise. The accompaniment music note prevalence histogram is then passed to the Map Input Pitch to Output Note block 214.

Those of ordinary skill in the art will recognize that a histogram is only one of a number of data binning or density estimation strategies that may be used to determine the relative likelihood of a particular note occurring. Various predictive modeling, analytics, algorithms, and similar techniques may be used to detect and exploit note occurrences, durations, and/or patterns to predict the likelihood or probability of a particular note occurring in the future. The likelihood of a particular note occurring may be determined using a table or computed using a formula or function, for example. One or more note boundaries may then be adjusted based on the likelihood or probability of a particular note occurring relative to one or more adjacent notes. Note boundaries may be reflected in a table or may by adjusting various weighting factors or parameters associated with note mapping as described in greater detail herein.

The input vocal signal 206 is typically a sung melody received by the main microphone of the pitch correction processor. This signal is passed on to an input pitch detector 208 which determines the pitch period of the sung note, as well as a classification of the type of input—at a minimum the classification determines if the input signal is periodic voiced class or aperiodic unvoiced class. Vowels are typical examples of the "voiced" class, while unvoiced fricatives are typical examples of the "unvoiced" class. Further classification may be done at this point into other parts of speech such as plosives, voiced fricatives, etc. Those of ordinary skill in the art will recognize that there are many pitch detection methods suitable for this application. Representative pitch detection methods are described in W. Hess, "Pitch and voicing determination", *Advances in Speech Signal Processing*, Sondhi and Furui, eds., Marcel Dekker, New York 1992, for example.

The detected input pitch from block 208 is then passed to the Estimate Note Occurrence block 210, which functions in a similar manner as block 204 as previously described for the accompaniment music signal. The result in this embodiment is a melody note prevalence histogram that is passed to the Map Input Pitch to Output Note block 214, although other techniques for analyzing the number of occurrences and/or duration of notes may be used as previously described. This block takes in any predefined key and scale information 212, which may be provided via the user interface, the detected input pitch period, and the melody and accompaniment music histograms, models, tables, etc., and produces an output note 230 based on dynamic input to output note mapping as described in greater detail herein with reference to FIG. 3.

The detected input pitch from block 208 is also passed to the Compute Pitch Stability block 218. This block is responsible for determining whether or not the pitch has stabilized, and is used to selectively reduce or minimize the perceived delay of the pitch correction system. When the pitch is unstable at times when the input note is just starting, or is changing from one note to another, optional block 218 detects this and reduces the target delay 232 or latency of the system as described in greater detail herein with reference to FIG. 5.

Once the output note 230 and delay 232 are determined by blocks 214 and 218, respectively, corresponding signals or data are passed to the Compute Shift Amount block 216. This block computes the difference between the detected input pitch and the desired output note, and sets the shift amount accordingly. The shift amount may be expressed as a shift ratio 234 corresponding to the ratio between input pitch period and desired output pitch period. For example, when no shift is desired, the shift ratio is set to 1. For a shift of one semitone lower in frequency for a twelve-tone equal temperament tuning, the shift ratio is set to approximately 1.06. The shift ratio 234 is adjusted based on the requested delay 232 to prevent running out of shifter buffer space. For example, even if a shift is desired to change the pitch from the input note to the output note, when the requested delay is zero, the shift will be delayed.

Various embodiments may include enhancements to provide a level of control over the type of pitch correction being applied. For example, if it is desired that the output pitch corrected signal have a robotic, unnatural quality such as often used as a desired vocal effect, then the shift ratio 234 can be used instantly without any smoothing. However, in most cases, a more natural output vocal sound is desired, such that the pitch correction rate is generally smoothed to avoid sudden changes in the output pitch. One common method for smoothing the pitch is to pass the signal containing the difference between the input and output pitch through a low pass filter where the filter cutoff is controlled according to user input such that a correction rate can be specified. Those of ordinary skill in the art will recognize that many other methods for smoothing the pitch correction amount may be used depending on the particular application and implementation.

Once the shift ratio 234 has been computed, it is passed to the pitch shifter 220, and the input signal pitch is shifted to the desired output note or pitch corrected vocal signal or data 222. There are several methods for shifting the pitch of an input signal known in the art. One method involves resampling a signal at different rates and using cross-fading at intervals which are pitch-multiples of the detected pitch period to minimize discontinuities in the output waveform. Pitch Synchronous Overlap and Add (PSOLA) is often used to resample human vocal signals because of the formant-preserving property inherent in the technique as described in Keith Lent, "An Efficient method for pitch shifting digitally sampled sounds." Computer Music Journal 13:65-71 1989. PSOLA divides the signal into small overlapping segments that are moved further apart to decrease the pitch or closer together to increase the pitch. The segments may be repeated multiple times to increase duration or some segments may be eliminated to decrease duration. The segments are then combined using an overlap add technique. Other methods for shifting the pitch may include linear predictive coding (LPC) to compute an LPC model of the input signal and remove the formants to obtain the residual signal or residue by passing the input signal through the computed LPC filter. The residual signal or residue can then be shifted using a basic non-formant corrected pitch shifting method. The shifted residue is then processed using the inverse input LPC filter to generate formant corrected, pitch shifted output.

Figure 3:
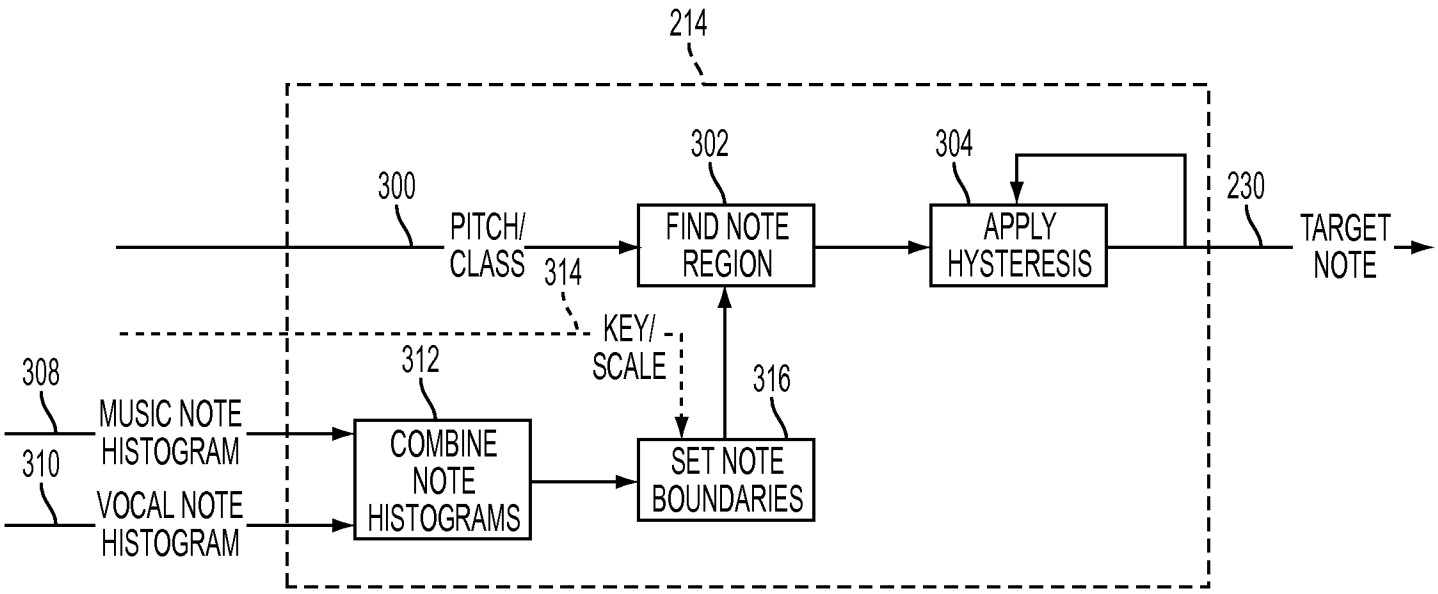
FIG. 3 is a block diagram of a representative embodiment of a dynamic input pitch to output note mapping subsystem.

FIG. 3 is a block diagram showing the details of the dynamic input pitch to output note mapping subsystem 214 as generally shown and described in FIG. 2. In this subsystem, the number/duration of note occurrences, captured by two note histograms 308, 310 in this example, computed from the accompaniment or background music 200 and from the vocal input signal 206 are first combined as represented by block 312. For embodiments where note occurrences are represented by histograms, the two histograms are combined into a single histogram at block 312. There are many ways of combining these histograms. In one embodiment, the histograms are combined using a weighted average in which each histogram contributes some fraction of the final content. In various embodiments, the accompaniment music is considered to be the more accurate source for note information as it often contains instruments that will generally be more accurately tuned to the correct notes. As such, the histogram 308 for the accompaniment music source may be weighted accordingly relative to the vocal source histogram 310. In some embodiments, the weighting may be determined based on the quality or clarity of the signals associated with background music 200 and/or vocal input source 206. In general, at least some information from the vocal source 206 should be included, particularly when the signal detected from the accompaniment music input 200 is noisy or otherwise of poor quality. Various embodiments employ dynamic weighting of the histogram information. In this case, the notes detected in each of the input sources are monitored for energy and accuracy, and the weighting factor is dynamically adjusted to more heavily weight the input with the higher accuracy/energy score.

Once a final histogram or other combined representation is obtained for the current input data, the note boundaries that define the mapping from input pitch frequency to output note are determined and/or adjusted as represented by block 316. In one embodiment, the note boundaries are determined at least in part based on an associated key/scale 314. The associated key/scale 314 may optionally be provided by a user via an associated interface or input, or may be determined automatically using histograms 308, 310, or other information. For example, if the key/scale is specified as being a chromatic 12-tone scale, then the note boundaries for each note may be placed ½ semitone above and below the note center frequencies.

As those of ordinary skill in the art will recognize, the likelihood of a particular note occurring may be based on a note history or number of occurrences of the note, or some other predictor as previously described. The number of occurrences may refer to the number of sample periods or frames through which the note extends and may therefore represent the duration of a particular note. For example, four (4) sixteenth notes may be counted, weighted, or otherwise recorded to influence the boundary adjustment in a similar fashion as one (1) quarter note. Likewise, tied notes that extend through multiple sampling periods or measures may be counted or weighted as multiple note occurrences depending on the particular application and implementation.

Various embodiments according to the present disclosure dynamically adapt the note boundaries based on the likelihood of a particular note occurring, which is represented by a combined note histogram produced by block 312 in this embodiment. This is done for each note boundary between note number k and note number k+1 as follows:

$$b(k) = n(k) + \frac{h_k^i}{(h_{k+1}^i + h_k^i)}[n(k+1) - n(k)]$$

where b(k) represents the note boundary above note number k, $h_k^i$ represents the histogram value at frame i for note number k, and n(k) is the normalized note number of the $k^{th}$ note in the input scale. Wrapping is applied when considering the last note in a scale as the upper boundary of the last note is the same as the lower boundary of the first note when all octaves are mapped to a single octave. Various embodiments may limit the boundary adjustments or determinations. Limits may be specified by the user or determined by the system. Different limits may be applied to different notes in some embodiments. Without limits, a particular note boundary could expand to a value that renders one or more adjacent notes unobtainable, which may not be desired.

To obtain the note number from the current note boundaries as determined or adjusted by block 316, the boundary values are searched to find the region in which the input note number lies as represented by block 302. The note boundaries may be stored in a corresponding table or other data structure contained within an associated computer readable storage device. In the example given above with the initial chromatic note boundaries placed ½ semitone above and below the note center, the note number 2.1 lies in the note 2 region defined by the lower boundary of 1.5 and the upper boundary of 2.5 (before dynamic adjustments), therefore note 2 is chosen as the best output note. In this way, an input pitch is converted to a normalized note number from 0 to 12 by computing the nearest note (regardless of octave) and the distance to that note in semitones. For example, an input note number of 2.1 would indicate that the note being sung is a "D" and it is sharp by an amount that is 10% of a semitone in the direction of E♭.

Figure 4:
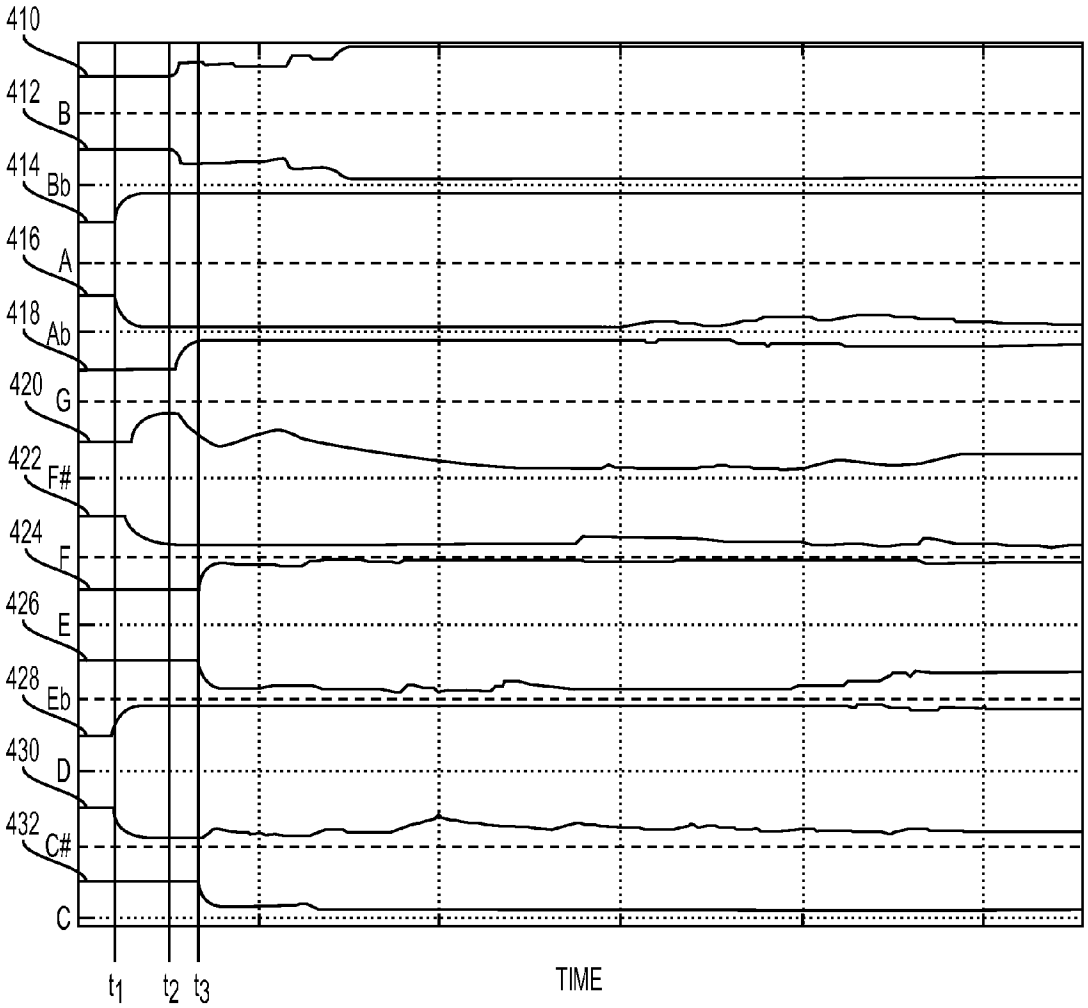
FIG. 4 is a plot illustrating operation of a representative embodiment with respect to adapting note boundaries over time for a chromatic input scale.

FIG. 4 is a plot illustrating operation of a representative embodiment with respect to adapting note boundaries over time for a chromatic input scale. With reference to FIGS. 1-4 for this example, the note boundaries, generally indicated by boundaries 410, 412, 414, 416, 418, 420, 422, 424, 426, 428, 430, and 432 are all equally spaced around the 12 possible input notes as shown for time $t<t_1$. In the representative embodiment illustrated, adjacent notes share a common boundary with note boundaries wrapping for each octave. For example, upper boundary 410 for note B is also the lower boundary for note C. Various other implementations may also detect the octave or register associated with a particular note such that note wrapping is not used.

As the representative embodiment in FIGS. 1-4 continues to operate and process notes from the background/accompaniment music 200, one or more note boundaries 410-432 may be dynamically adjusted as previously described. For example, at time $t_1$ the notes D and A are detected in the accompaniment music 200, with note F♯ detected shortly thereafter, which begins to influence the note histograms 308, causing the associated note boundaries for those regions as generally represented by lines 428, 430; 414, 416; and 420, 422, respectively, to expand. Because adjacent notes share a common boundary, dynamically adjusting or modifying boundaries to expand a note region also reduces the associated regions of adjacent notes. For example, increasing the region associated with note A by moving boundaries 414, 416 effectively decreases the regions associated with notes B♭ and A♭. Similarly, increasing the region associated with note F♯ by adjusting boundaries 420, 422 effectively decreases the regions associated with notes F and G.

In the representative embodiment illustrated, note boundaries associated with a particular note are adjusted based at least on previously occurring notes as represented by the note histograms, i.e. boundaries 414, 416 are adjusted relative to the center pitch or frequency for an A note. Adjustments may be applied such that only one boundary (upper or lower) is adjusted, or the upper and lower boundaries are adjusted by different amounts, for example, depending on the number of note occurrences/duration of the note being adjusted relative to adjacent notes. Similarly, because adjacent notes share a common boundary, any adjustment to one or more boundaries associated with a particular note may result in a corresponding adjustment of the adjacent note boundary. For example, the adjustment to note boundaries 428, 430 associated with note D results in adjustments to the note regions associated with adjacent notes C♯ and E♭.

As also shown in FIG. 4, at time $t_2$, notes G, B, and D are detected and the G and B regions begin to grow. The note D region and associated boundaries 428, 430 remain constant as this region and associated boundaries 428, 430 have reached a corresponding maximum allowed value. The maximum allowed value or adjustment may be specified using the user interface and stored in a computer readable storage device, or may be specified and fixed for a particular system. Depending on the particular application and implementation, different notes may have associated different maximum adjustment values.

At time $t_3$ the notes A, C♯, and E are detected, resulting in corresponding changes to boundaries 430, 432 associated with note C♯ and boundaries 424, 426 associated with note E. No additional change is made to boundaries 414, 416 for note A because these boundaries have reached their maximum allowable levels. Based on the dynamically modified boundaries, it is clear that in the time after $t_3$, the singer providing vocal input 206 could be off-pitch by a significant amount when attempting to sing an A note and the system would correctly map the note to an A. Conversely, the singer would have to be much nearer the correct pitch of the non-scale note A♭ before the pitch correction system would choose that note, because the dynamic adaptation of the associated boundaries 416, 418 has caused that note window to shrink.

Referring back to FIG. 3, once the note boundaries have been adapted as represented by block 316, they are used to find the output note 230 by determining the note region defined by the upper and lower boundaries in which the normalized input note lies as represented by block 302. To avoid situations where the output note jumps back and forth between two notes due to small variations near a note boundary, hysteresis is applied to the output note in the Apply Hysteresis block 304. Hysteresis is a well known concept in the art and there are many ways of applying hysteresis. One method is to compare the absolute difference between the currently selected output note and the corresponding input note with the absolute difference between the output note selected in the previous frame or sample and the current input note. If the absolute difference using the previous output note is within a tolerance, for example 0.1 semitones, of the absolute difference using the current output note, the previous output note is used even though its absolute difference is larger.

In some embodiments, the pitch correction system may be configured to respond to sudden accompaniment changes in addition to the dynamic note boundary adaptation described above. For example, when the accompaniment consists of a relatively clean guitar input signal, input notes can be detected with a high degree of accuracy with low latency. In this case, it is possible to override the historical or histogram-based dynamic note boundary modification and immediately correct to the notes and scale implied by the current accompaniment input.

To help a singer improve pitch accuracy, it may be helpful for the singer to see a visual indication of the difference between the input vocal pitch and the desired or target output pitch generated by the system. The pitch correction systems and methods according to various embodiments described herein have estimates for both these values. As such, in one embodiment, a display is used to provide a visual indication of the input vocal pitch, desired or target "in-tune" output pitch, and/or the difference between the input and output pitches. The display may be selectively configured to show the difference in pitch, or alternatively to show the extent that the pitch correction system is being relied upon to correct the pitch.

Figure 5:
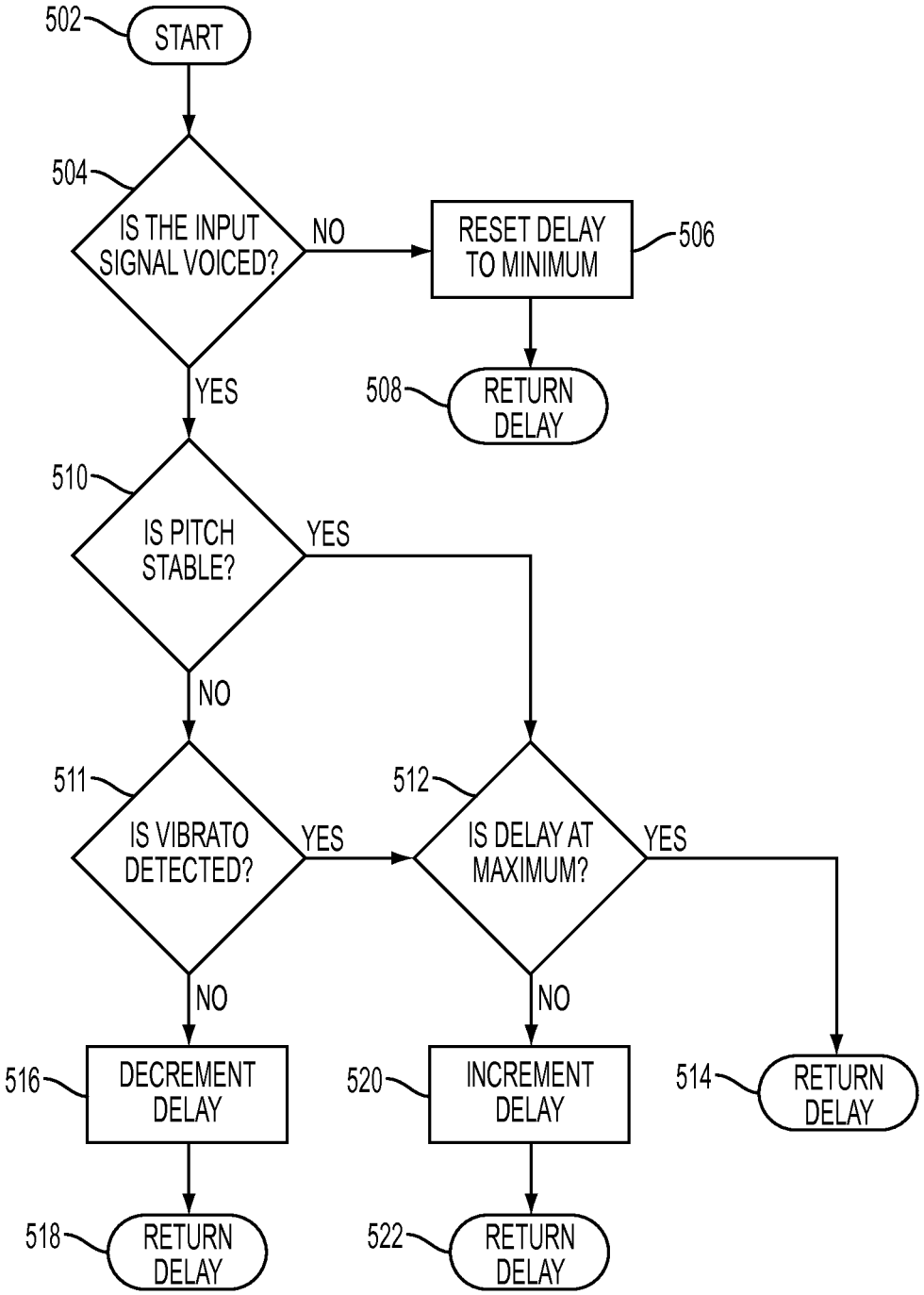
FIG. 5 is a flow chart illustrating operation of a representative embodiment of a system or method for pitch correction with respect to a dynamically adjusted delay based on input note stability.

FIG. 5 is a flow chart illustrating operation of a representative embodiment of a system or method for pitch correction with respect to a dynamically adjusted delay based on input note stability. The representative embodiment illustrated includes a pitch shifter (such as 220, FIG. 2) configured to operate based on a requested delay. Those of ordinary skill in the art will appreciate that pitch shifters may result in output signals with variable delays that change due to the way most shifters operate. For example, an instrumental pitch shifter will resample the input signal at a rate slower than the input sample rate to shift down in pitch, and it will resample at a rate faster than the input rate to shift up in pitch. Shifting down in this case causes the shifter to "fall behind" the input resulting in an increasing delay. Shifting up will cause the shifter to "catch up" to the input resulting in a need to cross fade back in the buffer to provide extra buffer space. To avoid rapid cross fading and achieve desired pitch shifting quality, it is desirable to keep the delay of the system high enough when shifting the pitch. However, when the pitch is not being shifted, there is no need to maintain this delay. The shifter can essentially incur no delay when the requested shift ratio is equal to one. Because in typical operation, the pitch shift ratio in a pitch correction system will be one during unvoiced and silent regions, and then will only change to other ratios relatively slowly due to the smoothing of the shift ratio. Various embodiments of the present disclosure take advantage of this fact to reduce the perceived delay of the pitch correction system.

Referring to FIG. 5, the algorithm for dynamically adjusting latency of the pitch correction system begins at 502. Block 504 determines if the input signal is a vocal signal. If the pitch class is not voiced i.e. the input signal is aperiodic, as determined at 504, the delay or latency is to a minimum value at 506 and this minimum value is returned for use by the pitch shifter as represented at 508. If the input signal is voiced as determined at 504, then a stability check is performed on the signal as represented by block 510. The stability check can be performed in many ways. In one method, the differences between pitch values from adjacent frames are analyzed and the pitch is declared to be unstable when the deviation in one or more past frames becomes larger than a tolerance. In another method, the current pitch period is compared to a time averaged pitch contour and the pitch is declared unstable when the deviation from that average is larger than a tolerance. If the pitch is determined to be stable at 510, and the delay has not reached a corresponding maximum value as determined at 512, then the delay is incremented as represented by block 520 and returned for use by the pitch shifter (such as 220, FIG. 2) as represented by block 522. Note that the maximum value can be an adaptive value that only gets as large as required for a given pitch shift ratio, because the closer the shift ratio is to one, the less delay required to minimize the number of cross fades in any given time frame.

If the pitch is determined to be unstable at 510, the next test is to determine if the instability is actually due to controlled vibrato, in which the input pitch contour rises and falls in frequency according to a regular pattern as represented by block 511. There are many ways to detect vibrato in a signal. One way is to look for regular patterns in the locations where the pitch contour crosses a longer term average of the recent pitch contour. Another way is to fit one or more sinusoids to the pitch contour through error minimization techniques, and then to declare that the signal is a vibrato signal if the fitting error is low enough. If vibrato is detected at 511, the input pitch contour is considered to be stable and the algorithm flow follows the same path through step 512. Otherwise, the input pitch contour is considered to be unstable, and the delay is decremented as represented by block 516 and returned to the pitch shifter as represented by block 518.

As demonstrated by the flowchart of FIG. 5, a system or method for pitch correction according to embodiments of the present disclosure may dynamically alter the latency of the pitch correction algorithm to reduce the perceived delay experienced by a singer. The stability detector represented by blocks 510 and 511 determines when a singer intends to hit a stable note (with or without vibrato). Before a note is stable, the system applies no pitch correction, and as a result, sets the latency of the system to a minimal value. When the algorithm detects that the note is stabilizing and pitch correction is required, the delay is increased to build up buffer space to begin correcting the pitch. The result is a pitch correction system and method with dynamic latency where the latency is lower during instances where it is more perceptible, such as during onsets and sudden note changes, and higher during instances where the latency is less noticeable or troublesome to the singer. Furthermore, the latency can be similarly reduced when the input signal is aperiodic, for example during sibilance sounds.

As those of ordinary skill in the art will recognize, the representative embodiments described above include various advantages relative to prior art pitch correction techniques. For example, embodiments according to the present disclosure dynamically adapt the input to output mapping over the course of a song when the local key is different from the global key without requiring user input. The systems and methods provide a higher probability of selecting musically correct output notes while not prohibiting output notes that are not within a determined scale, i.e. allowing selection of non-diatonic output notes. In addition, systems and methods according to the present disclosure significantly reduce note flipping between two output notes when the input note is oscillating between a high frequency of occurrence note and a low frequency of occurrence note. Various embodiments also reduce the perceived latency by reducing latency during periods where pitch correction is not required or appropriate.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention. While various embodiments may have been described as providing advantages or being preferred over other embodiments or prior art implementations with respect to one or more desired characteristics, as one skilled in the art is aware, one or more characteristics may be compromised to achieve desired system attributes, which depend on the specific application and implementation. These attributes include, but are not limited to: cost, durability, life cycle cost, marketability, appearance, packaging, size, ease of use, processing time, manufacturability, ease of assembly, etc. The embodiments described herein that are described as less desirable than other embodiments or prior art implementations with respect to one or more characteristics are not outside the scope of the disclosure and may be desirable for particular applications.

What is claimed is:

1. A method for processing a vocal signal and a non-vocal signal, comprising:

detecting vocal input notes in the vocal signal;

determining that a pitch of a vocal input note is stable based on a detected vibrato;

mapping the vocal input notes to corresponding vocal output notes based on associated upper and lower note boundaries;

shifting pitch of the vocal input notes to a pitch associated with the corresponding vocal output notes; and adjusting delay of pitch shifting based on whether the pitch of the vocal input note is stable.

2. The method of claim 1 wherein adjusting the delay of pitch shifting further comprises performing one of increasing the delay of pitch shifting in response to detecting a stable pitch of the vocal input note, and decreasing the delay of pitch shifting in response to detecting an unstable pitch of the vocal input note.

3. The method of claim 1, further comprising:

generating a vocal input note likelihood of occurrence based on a number of occurrences of each detected vocal input note;

detecting non-vocal input notes in the non-vocal signal;

generating a non-vocal note likelihood of occurrence based on a number of occurrences of each detected non-vocal input note; and combining the vocal note likelihood of occurrence and the non-vocal note likelihood of occurrence to generate a combined note likelihood of occurrence.

4. The method of claim 3 wherein the vocal note and non-vocal note likelihoods of occurrence are represented by respective note histograms.

5. The method of claim 3 wherein adjusting the delay of pitch shifting comprises resetting the delay of pitch shifting to a minimum value in response to detecting that the vocal signal is independent of a voice input.

6. The method of claim 1 further comprising:

receiving an input designating a key/scale, wherein adjusting the upper and lower note boundaries includes adjusting the upper and lower note boundaries based on the key/scale.

7. A system for adjusting pitch of an audio signal, comprising:

a first input configured to receive a first signal;

a second input configured to receive a second signal;

an output configured to provide a pitch-adjusted first signal; and a processor in communication with the first and second inputs and the output, the processor detecting input first notes in the first signal and input second notes in the second signal, generating a second note likelihood of occurrence based on number of occurrences of each detected second input note, mapping the input first notes to output first notes, each output first note having an associated upper note boundary and lower note boundary, modifying at least one of the upper note boundary and the lower note boundary of at least one output note in response to a combined note likelihood of occurrence including the combination of a first note likelihood of occurrence and the second note likelihood of occurrence, shifting pitch of the first signal to substantially match an output note pitch of the corresponding output first note, and generating a signal on the output corresponding to the shifted pitch first signal.

8. The system of claim 7 wherein the processor is further configured to dynamically modify a delay for shifting the pitch in response to stability of an input first note.

9. The system of claim 7 wherein the processor is configured to modify at least one of the upper note boundary and the lower note boundary in response to a designated key/scale.

10. The system of claim 9 wherein the designated key/scale is detected based on the input second notes.

11. The system of claim 9 wherein the designated key/scale is received via a user interface in communication with the processor.

12. A method for adjusting pitch of an audio signal, comprising:

detecting input notes in the audio signal;

mapping the input notes to corresponding output notes, each output note having an associated upper note boundary and lower note boundary;

shifting pitch of the input notes to match an associated pitch of corresponding output notes;

dynamically adjusting delay associated with shifting the pitch of the input notes in response to a detected stability of the input notes, wherein dynamically adjusting the delay comprises decreasing a delay of pitch shifting in response to detecting an unstable pitch.

13. The method of claim 12 wherein dynamically adjusting the delay comprises increasing the delay when a stable input note is detected.

14. The method of claim 13 wherein dynamically adjusting the delay comprises increasing the delay when an input note having vibrato is detected.

15. The method of claim 12 wherein the audio signal includes a vocal signal and a non-vocal signal, and wherein detecting the input notes includes detecting vocal input notes and non-vocal input notes, the method further comprising:

modifying at least one of the upper note boundaries and the lower note boundaries for the output notes based on a number of occurrences of the vocal input notes and the non-vocal input notes.

16. The method of claim 12 further comprising:

detecting a key/scale in response to the input notes in the audio signal, wherein modifying at least one of the upper and lower note boundaries comprises modifying at least one of the upper note boundary and lower note boundary in response to the key/scale.

* * * * *